US007795526B2

(12) United States Patent
Park et al.

(10) Patent No.: US 7,795,526 B2
(45) Date of Patent: Sep. 14, 2010

(54) APPARATUS AND METHOD FOR REPRODUCING MIDI FILE

(75) Inventors: Yong Chul Park, Seoul (KR); Jung Min Song, Seoul (KR); Jun Yup Lee, Yongin-si (KR); Yong Hee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1222 days.

(21) Appl. No.: 11/304,389

(22) Filed: Dec. 14, 2005

(65) Prior Publication Data

US 2006/0129388 A1 Jun. 15, 2006

(30) Foreign Application Priority Data

Dec. 14, 2004 (KR) ..... 10-2004-0105598

(51) Int. Cl.
*G10H 7/00* (2006.01)

(52) U.S. Cl. ..... 84/645; 84/615; 84/616; 84/627

(58) Field of Classification Search ..... None
See application file for complete search history.

(56) References Cited

U.S. PATENT DOCUMENTS 5,315,057 A 5/1994 Land et al.
5,744,739 A * 4/1998 Jenkins ..... 84/603
5,824,936 A * 10/1998 DuPuis et al. ..... 84/663
5,917,917 A * 6/1999 Jenkins et al. ..... 381/63
5,920,843 A * 7/1999 Fay ..... 704/503
6,096,960 A * 8/2000 Scott ..... 84/603
6,285,767 B1 * 9/2001 Klayman ..... 381/17
6,362,411 B1 3/2002 Suzuki et al.
6,365,817 B1 4/2002 Suzuki et al.
2006/0086238 A1 * 4/2006 Lee et al. ..... 84/645

FOREIGN PATENT DOCUMENTS

JP 2003-330468 11/2003
KR 100189998 1/1999

* cited by examiner

*Primary Examiner*—Marlon T Fletcher
(74) *Attorney, Agent, or Firm*—Lee, Hong, Degerman, Kang & Waimey

(57) ABSTRACT

Apparatus and method for reproducing a MIDI-based music file are provided. According to the apparatus and method, a plurality of notes and note reproduction times are extracted from the MIDI file, a section where envelope values of sound source samples exponentially reduce is changed into a linear section, and the sound source samples are outputted according to the note reproduction times by reflecting the slope of the linear section.

12 Claims, 3 Drawing Sheets

APPARATUS AND METHOD FOR REPRODUCING MIDI FILE

This application claims the benefit of the Korean Patent Application No. 10-2004-0105598, filed on Dec. 14, 2004, which is hereby incorporated by reference as if fully set forth herein.

BACKGROUND OF THE INVENTION

1. Field of the Invention

The present invention relates to an apparatus and a method for reproducing a MIDI-based music file.

2. Description of the Related Art

To reproduce a MIDI (musical instrument digital interface) file into a real sound, many methods can be used. Representative methods include a frequency modulation (FM) synthesis method and a wave table synthesis method. The FM synthesis method reproduces a sound by synthesizing basic waveforms. Since the FM synthesis method does not require a separate sound source, it has an advantage of using a small amount of memory but has a disadvantage of not reproducing a natural sound close to an original sound. On the contrary, the wave table synthesis method stores sound sources for each instrument and each note of each instrument in advance and synthesizes these sound sources to reproduce a sound. The wave table synthesis method has a disadvantage of using a large amount of memory in storing the sound sources, but has an advantage of reproducing a natural sound close to an original sound.

To hear a sound in real-time through a MIDI file reproducing system, a process of synthesizing a sound using a MIDI file and a sound source should be performed in real-time. A process of synthesizing a sound requires a considerable amount of processor resources. Parts that use the processor resources in the MIDI file reproducer include an envelope generator. The envelope generator is used to generate the envelope of a sound waveform determining the size of the volume or the pitch of a sound. Therefore, the envelope generator has a considerable influence on sound quality and uses a large portion of the processor resources.

Here, the envelope includes an envelope for the volume and an envelope for the pitch. Referring to FIGS. 1 and 2, the envelope is divided into four steps of Attack 12, Decay 13, Sustain 17, and Release 14 after Delay 11 starting from Note-On 15. Though the envelope is expressed in a linear form in FIG. 1, it can have a linear form or a concave form depending on the kind of the envelope and the characteristic of each step. Also, articulation data, which is information representing a unique characteristic of a sound source, contains time information for the four steps of Attack 12, Decay 13, Sustain 17, Release 14 and is used in synthesizing a sound. One note is reproduced by applying the above envelope and a plurality of notes are gathered to complete one musical piece.

When one note is reproduced by applying the envelope of FIG. 2, an envelope waveform should exponentially reduce with respect to a time axis to achieve a smooth waveform. Since the size of an envelope has been illustrated with a dB (decibel) scale with respect to a time axis in FIG. 1, the envelope waveform has a straight line shape. On the contrary, referring to FIG. 2, it is revealed that a note exponentially reduces during steps Decay and Release. However, since it is difficult for a reproducing apparatus (e.g., a mobile terminal) having limited resources to reproduce a note in this manner, development of a new technology is required to reproduce sufficient sound quality even when the limited resources are used.

FIG. 3 is a view of an apparatus for reproducing a MIDI file. The apparatus includes: a MIDI parser 21 for extracting a plurality of notes and note reproduction times from a MIDI file; a MIDI sequencer 22 for sequentially outputting the extracted note reproduction times; a wave table 24 for registering at least one sound source sample; and a frequency converter 23 for frequency-converting at least one registered sound sample into sound source samples that correspond to respective notes whenever the note reproduction time is outputted.

The MIDI file inputted to the MIDI parser 21 contains information regarding predetermined music stored in advance in a storage medium thereof. The MIDI file can include a plurality of notes and note reproduction times. A note is information representing a sound. For example, the note represents information (e.g., Do, Re, and Mi) regarding a musical scale. Since the note is not a real sound, it should be reproduced into actual sound sources. Also, the note reproduction time means a reproduction time of each of the notes contained in the MIDI file and is information regarding the same length of a sound. For example, when the reproduction time of a note "Re" is ⅛ second, a sound source that corresponds to the note "Re" is reproduced for ⅛ second when it is reproduced.

Sound sources for each instrument and each note of each instrument are registered in the wave table 24. A musical scale includes 1 to 128. There is a limitation in registering all of sound sources for the musical scale (i.e., notes contained therein) in the wave table 24. Therefore, sound source samples for only several representative notes are registered in the wave table 24.

When the reproduction time for the note is inputted, the frequency converter 23 judges whether a sound source for the relevant note is present in the wave table 24 and frequency-converts the note into a sound source that correspond to the relevant note. The frequency converter 23 may be an oscillator.

In the case where a sound source for the relevant note is not present in the wave table 24, the frequency converter 23 reads a predetermined sound source sample from the wave table 24 and frequency-converts the read sound source sample into a sound source sample that corresponds to the relevant note. In the case where a sound source for the relevant note is present in the wave table 24, the frequency converter 23 reads the relevant sound source sample from the wave table 24 and outputting the same without a separate frequency conversion. For example, in the case where a sound source sample registered in the wave table 24 is sampled by 20 kHz and a note of desired music is sampled by 40 kHz, the sound source sample is finally frequency-converted into 40 kHz and reproduced. That is, the sound source sample of 20 kHz can be frequency-converted and outputted into a sound source sample of 40 kHz by the frequency converter 23.

The above processes are repeatedly performed whenever the note reproduction time for each note is inputted. However, in the case where the frequency conversion is repeatedly performed whenever the note reproduction time for each note is inputted as described above, a considerable amount of operations is required, so that the relevant processor can be overloaded. Moreover, the relevant MIDI file should be reproduced and outputted in real-time. However, since the frequency conversion is performed for each note as described above, music may not be reproduced in real-time. In short, the MIDI reproducing apparatus can reproduce music substantially only in the case where it uses a considerable amount of processor resources.

SUMMARY OF THE INVENTION

Accordingly, the present invention is directed to an apparatus and a method for reproducing a MIDI file that substantially obviate one or more problems due to limitations and disadvantages of the related art.

An object of the present invention is to provide apparatus and method for reproducing a MIDI file, capable of reproducing a MIDI file of high quality by changing a nonlinear envelope into a linear envelope when a sound volume exponentially reduces in synthesizing MIDI-based music.

Another object of the present invention is to provide apparatus and method for reproducing a MIDI file, capable of guaranteeing a high quality sound with limited processor resources by changing a nonlinear envelope into a linear envelope when a sound volume exponentially reduces in synthesizing MIDI-based music.

A further another object of the present invention is to provide apparatus and method for reproducing a MIDI file characterized in that a plurality of notes and note reproduction times are extracted from the MIDI file, a section where envelope values of sound source samples exponentially reduce is changed into a linear section, and the sound source samples are outputted according to the note reproduction times by reflecting the slope of the linear section.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a method for reproducing a MIDI file, the method including: generating an envelope for reproduction of a MIDI file; changing the envelope into a linear envelope; and reproducing the MIDI file by reflecting the linear envelope.

In another aspect of the present invention, there is provided a method for reproducing a MIDI file, the method including: generating an envelope according to a note and a note reproduction time for reproduction of a MIDI file; setting a section to change into a linear section among sections of the envelope; calculating the slope of the set section; and outputting sound source samples that correspond to an inputted MIDI file by applying a linear envelope according to the calculated slope.

In a further another aspect of the present invention, there is provided an apparatus for reproducing a MIDI file, the apparatus including: means for extracting notes and note reproduction times from the MIDI file; means for setting a section to change into a linear section among sections of the envelope on the basis of the extracted notes and note reproduction times; means for calculating the slope of the set linear section of the envelope; and means for reproducing a relevant note by applying the calculated slope to the envelope.

It is possible to reproduce a high quality MIDI music file using a CPU of low specification by applying a linear structure that minimizes sound quality deterioration to prevent an increase of a CPU operation amount caused by exponential reduction when a sound volume reduces.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

When one note is reproduced by applying an envelope in a MIDI-based music file, the envelope should exponentially (i.e., smoothly) reduce and finally fall down to zero so as to reproduce the note in the most ideal manner. However, since it is difficult that a reproducing apparatus (e.g., a mobile terminal) having limited resources reproduces a note in this manner, the present invention changes the envelope into a linear envelope and applies the linear envelope to MIDI synthesis, thereby making possible reproduction of high quality sound even when limited processor resources are used.

Figure 1:
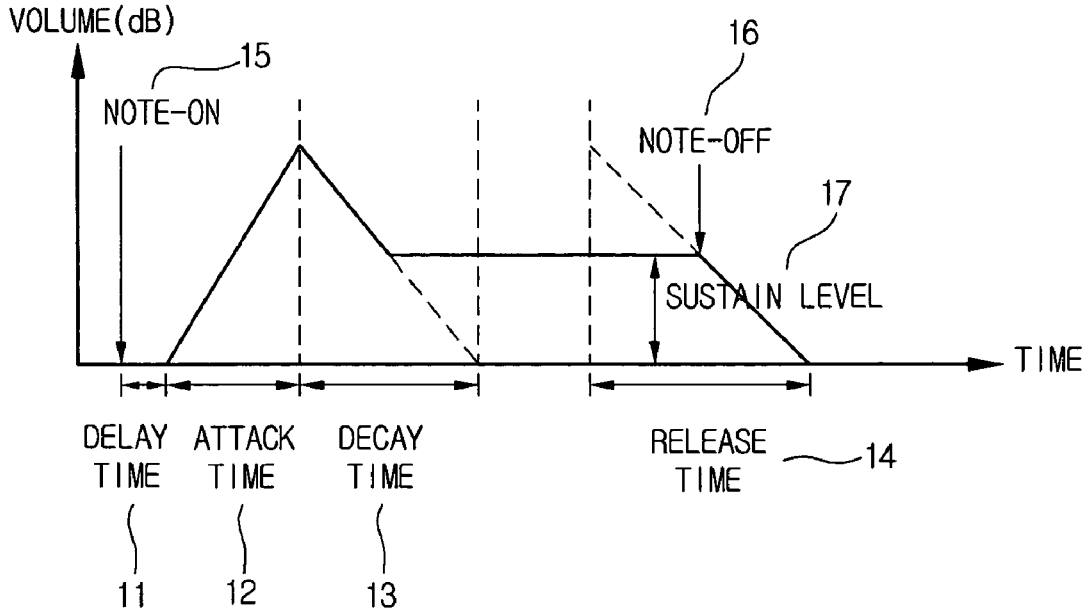
FIGS. 1 and 2 are views illustrating an envelope during reproduction of a MIDI file.
Figure 2:
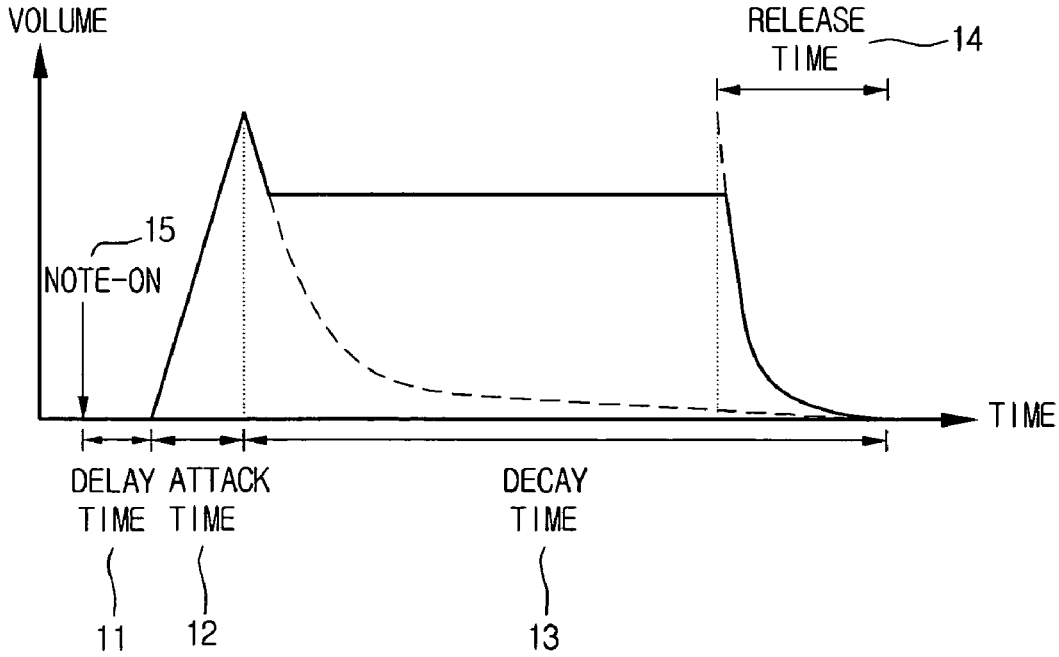
Figure 3:
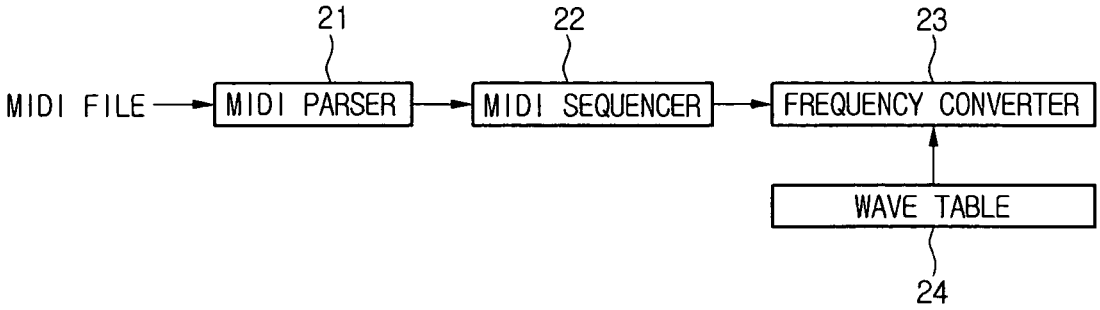
FIG. 3 is a view of an apparatus for reproducing a MIDI file.
Figure 4:
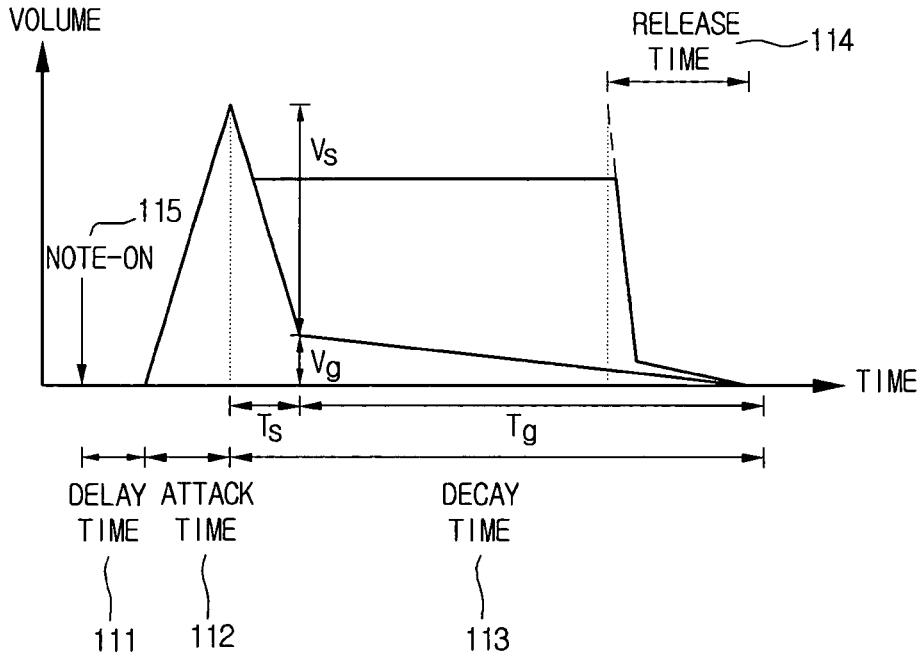
FIG. 4 is a view illustrating an envelope during reproduction of a MIDI file according to an embodiment of the present invention.

FIG. 4 is a view illustrating an envelope during reproduction of a MIDI file according to an embodiment of the present invention. After Delay 111 starting from Note-On 115, there are time sections such as Attack 112, Decay 113, Sustain 117, and Release 114. The Decay time section 113 and the Release time section 114 are described using an envelope having different linear slope. That is, the related art curved envelope is described using a straight line. The slopes of the Decay time section 113 and the Release time section 114 outputted from an envelope generator include a section that rapidly reduces at the front portion of the envelope and a section that smoothly reduces at the rear portion of the envelope.

The present invention determines a point through which the waveform of an envelope changes from a portion having a steep slope into a portion having a gentle slope as an optimized point that allows the envelope to change into a linear envelope. The portion having the steep slope and the portion having the gentle slope are changed into linear sections using the point for a reference.

For example, the Decay time section 113 and the Release time section 114 represent a time taken until a sound volume reduces from 0 dB to 96 dB in a dB scale. Assuming that an entire size is 1, −10 dB corresponds to 0.1. Also, a time taken until 0 dB reduces 10 dB is 10/96=0.14, that is, about 1/10 of an entire Decay time section 113. Therefore, a time taken until a sound volume reduces from 1 to 0.1 is about 0.1×Decay time section 113. Therefore, a time taken until the rest sound volume 0.1 reduces to 0 is about 0.9×Decay time section 113, which corresponds to the most portion of the Decay time section 113.

When the section to change into a linear section is selected, the slope is calculated for each of the section having the steep slope and the section having the gentle slope. Assuming that the section having the steep slope is Ts, the section having the gentle slope is Tg, amounts of change of a sound volume for the sections are Vs and Vg, respectively, the slope of the envelope may be given by Equations below.

Steep slope: $Ys=Vs/Ts$

Gentle slope: $Yg=Vg/Tg$

Next, the slope of the envelope calculated for each of the sections is differently applied for the sections when the apparatus for reproducing the MIDI file generates an envelope. That is, according to the present invention, each of the Decay section and the Release section is divided into the section having the steep slope and the section having the gentle slope depending on a degree the slope of the envelope falls down as illustrated in FIG. 4 and the envelope generator is applied to the divided sections.

An envelope in the linear Decay section and an envelope in the linear Release section are applied to the envelope generator, so that an entire envelope becomes a shape similar to that of the envelope before the envelope is changed into a linear envelope. Of course, each of the two sections may be divided into more than two linear sections, so that an envelope more similar to the envelope before the envelope is changed into the linear envelope may be achieved. As described above, it is possible to provide an apparatus for reproducing a MIDI file, capable of minimizing sound quality deterioration and reducing the load of a CPU by changing portions of the envelope into linear portions.

Figure 5:
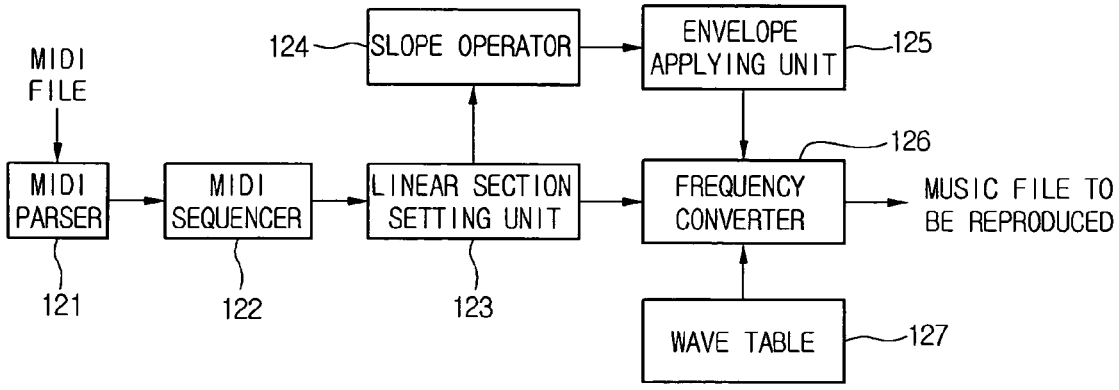
FIG. 5 is a view of an apparatus for reproducing a MIDI file according to an embodiment of the present invention.

FIG. 5 is a view of an apparatus for reproducing a MIDI file according to an embodiment of the present invention.

Referring to FIG. 5, the apparatus includes: a linear section setting unit 123 for changing a Decay section and a Release section of a note to reproduce into a linear Decay section and a linear Release section, respectively; a slope operator 124 for determining a sound volume to what rate during the linear sections; and an envelope applying unit 125 for applying a calculated slope value to an envelope generator.

Referring to FIG. 5, the apparatus will be described in more detail. The apparatus includes: a MIDI parser 121 for extracting a plurality of notes and note reproduction times from the MIDI file; a MIDI sequencer 122 for outputting sound source samples according to the plurality of note reproduction times extracted from the MIDI parser 121; the linear section setting unit 123 for changing the slope of a Decay section and a Release section in the envelope into a linear Decay section and a linear Release section, respectively; the slope operator 124 for operating the linear sections changed by the linear section setting unit 123; the envelope applying unit 125 for applying the operated slope to an envelope; a wave table 127 for registering the sound source samples; and a frequency converter 126 for converting the frequency of a music file to be outputted.

A MIDI file inputted into the MIDI parser 121 is a file containing information regarding a piece of predetermined music and recorded on a recording medium. The MIDI file may contain a plurality of notes and note reproduction times. A note is information representing a sound. For example, the note represents information (e.g., Do, Re, and Mi) regarding a musical scale. A MIDI file can be a musical piece consisting of a start and an end of one song. This musical piece can include numerous musical scales and time lengths of respective musical scales. Therefore, a MIDI file can contain information regarding notes that correspond to respective musical scales and the reproduction times of the respective notes. Since the note is not a real sound, it should be reproduced using actual sound sources. The note reproduction time means a reproduction time of each of the notes contained in the MIDI file and is information regarding the same length of a sound. For example, when the reproduction time of a note "Re" is ⅛ second, a sound source that corresponds to the note "Re" is reproduced for ⅛ second when it is reproduced.

When a MIDI file is inputted, the MIDI parser 121 pareses the inputted MIDI file to extract a plurality of notes and note reproduction times contained in the MIDI file. Here, the note reproduction times means respective reproduction times for the respective notes. The notes are inputted into the MIDI sequencer 122. The MIDI file inputted to the MIDI parser 121 can contain tens of notes through 128 notes regarding a musical scale.

Sound sources for each instrument and each note of each instrument are registered in the wave table 127. A musical scale includes 1 to 128. There is a limitation in registering all of sound sources for the musical scale (i.e., notes contained therein) in the wave table 127. Therefore, sound source samples for only several representative notes are registered in the wave table 127.

The apparatus for reproducing the MIDI file frequency-converts predetermined sound source samples registered in the table 127 into sound source samples that correspond to notes contained in the inputted MIDI file and reproduces the same. When a reproduction time for a note is inputted, the frequency converter 126 judges whether a sound source that corresponds to the note exists on the wave table 127 to frequency-convert the sound source into a sound source of the note. The frequency converter 126 may be an oscillator.

According to the related art, since sound source samples that correspond to each note are generated for each note in real-time, an operation amount explosively increases, which causes an overload of a CPU, so that reproduction in real-time is difficult to achieve. Therefore, the present invention changes the slopes of a Decay section and a Release section of the sound source samples into linear slopes to minimize a use amount of the CPU, thereby achieving high quality reproduction of the MIDI file under a CPU with low specification.

When receiving a reproduction time of each note from the MIDI parser 121, the MIDI sequencer 122 sequentially reads, from the wave table 127, sound source samples that correspond to respective notes according to the respective reproduction times of the respective notes and outputs the same, so that the reproduction of the MIDI file can be performed.

An envelope having the waveform of an exponential function should be maintained for the Decay section and the Release section so that a most ideal note may be reproduced for each note when a note contained in the MIDI file is reproduced. For that purpose, the envelope generator should change the slope of the envelope depending on cases. Otherwise, the Decay time section 113 and the Release time section 114 are lengthened and sound quality distortion may be generated. According to the present invention, the linear section setting unit 123 approximates an envelop value using a value close to an exponential function, so that the MIDI file may be reproduced without sound quality distortion and a use amount of CPU resources may be remarkably reduced in comparison with the method for reproducing the MIDI file according to the related art.

The slope operator 124 performs an operation on the value of the slope for each section contained in the envelope that is set by the linear section setting unit 123. The linear section setting unit 123 divides the Decay section and the Release section into a plurality of sub-sections, and sets a slope change point for calculating an optimum envelope slope in each of the sections. As described above, the slope of the envelope consists of a steep slope (Ys=Vs/Ts) and a gentle slope (Yg=Vg/Tg). The slope of the envelope calculated by the slope operator 124 is applied to a sound source sample through the envelope applying unit 125. The slope operator 124 performs an operation on the slopes of the Decay section and the Release section to change the section of the envelope into linear sections.

That is, the related art curved envelope is described using straight lines. The linear section setting unit 123 determines a point through which the waveform of the envelope changes from a portion having a steep slope changes into a portion having a gentle slope as an optimized point that allows the envelope changes into a linear envelope. The slope operator 124 calculates the slopes of the portion having the steep slope and the portion having the gentle slope using the set point as a reference.

For example, the Decay time section 113 and the Release time section 114 represent a time taken until a sound volume reduces from 0 dB to 96 dB in a dB scale. Assuming that an entire size is 1, −10 dB corresponds to 0.1. Also, a time taken until 0 dB reduces 10 dB is 10/96=0.14, that is, about 1/10 of an entire Decay time section 113. Therefore, a time taken until a sound volume reduces from 1 to 0.1 is about 0.1×Decay time section 113. Therefore, a time taken until the rest sound volume 0.1 reduces to 0 is about 0.9×Decay time section 113, which corresponds to the most portion of the Decay time section 113.

When the section to change into a linear section is selected, the slope is calculated for each of the section having the steep slope and the section having the gentle slope. Assuming that the section having the steep slope is Ts, the section having the gentle slope is Tg, amounts of change of a sound volume for the sections are Vs and Vg, respectively, then the slope of each section contained in the envelope may be calculated using equations Ys=Vs/Ts for steep slope and Yg=Vg/Tg for gentle slope.

Next, the slope of the envelope calculated for each of the sections is differently applied for the sections when the apparatus for reproducing the MIDI file generates an envelope. That is, according to the present invention, each of the Decay section and the Release section is divided into the section having the steep slope and the section having the gentle slope depending on a degree the slope of the envelope falls down as illustrated in FIG. 4 and the envelope applying unit 125 applies the divided sections to a relevant sound source sample.

The method for changing an envelope into a linear envelop and outputting/reproducing a relevant MIDI sample according to the linear envelope is effective when it is applied to a section that exponentially changes, particularly, at least one of a Decay section and a Release section. For example, the method may be applied to the Decay section (Ts+Tg) in FIG. 4, or a method for calculating slopes to be applied to each of the Decay section and the Release section, changing a relevant section of an envelope on the basis of the calculated slopes, and applying the linear section of the envelope to reproduce a relevant MIDI sample, may be also used.

Since an entire envelope becomes similar to an envelope before a linear envelope by applying the linear Decay section and the linear Release section to the entire envelope, it is possible to reproduce a MIDI file having almost no sound quality distortion and to reproduce a MIDI file of high quality even when reproducing the MIDI file using limited CPU resources.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method for reproducing a musical instrument digital interface (MIDI) file, the method comprising:

generating an envelope for reproduction of the MIDI file;

selecting at least one section from the envelope to change into a linear section;

dividing the selected at least one section into a plurality of sub-sections at a point where a slope of the envelope changes between a relatively steep slope and a relatively gently slope;

changing the plurality of sub-sections into a plurality of linear sections to generate a linear envelope; and reproducing the MIDI file by reflecting the linear envelope.

2. The method according to claim 1, wherein the selected at least one section is a Decay section of the envelope.

3. The method according to claim 1, wherein the selected at least one section is a Release section of the envelope.

4. The method according to claim 1, wherein at least one other section contained in the envelope is changed into a linear section.

5. The method according to claim 1, wherein at least two sections of the envelope are changed into linear sections.

6. The method according to claim 1, wherein the selected at least one section of the envelope is selected from sections of the envelope having slopes that are exponentially reduced.

7. The method according to claim 1, wherein the slope of the selected at least one section of the envelope is calculated using a length of the selected at least one section and an amount of change of a sound volume in the selected at least one section.

8. A method for reproducing a musical instrument digital interface (MIDI) file, the method comprising:

generating an envelope according to a note and a note reproduction time for reproduction of the MIDI file;

selecting a section from among a plurality of sections of the envelope to change into a linear section;

dividing the selected section into two sub-sections at a point used for a reference where a slope of the envelope changes between a relatively steep slope and a relatively gentle slope;

calculating a slope of each of the two sub-sections; and outputting sound source samples that correspond to the MIDI file by applying a linear envelope according to the calculated slope of each of the two sub-sections.

9. The method according to claim 8, wherein the selected section comprises at least one of a Decay section and a Release section of the envelope.

10. An apparatus for reproducing a musical instrument digital interface (MIDI) file, the apparatus comprising:

means for extracting notes and note reproduction times from the MIDI file;

means for selecting a section from among a plurality of sections of an envelope to change into a linear section on the basis of the extracted notes and note reproduction times;

means for dividing the selected section into two sub-sections at a point used for a reference where a slope of the envelope changes between a relatively steep slope and a relatively gentle slope;

means for calculating a slope of a set linear section contained in the envelope; and means for reproducing a relevant note by applying the calculated slope to the envelope.

11. The apparatus according to claim 10, wherein the selected section comprises at least one of a Decay section and a Release section of the envelope.

12. The apparatus according to claim 10, wherein the slope of the set linear section is calculated using a length of the set linear section and an amount of change of a sound volume in the set linear section.

* * * * *